United States Patent [19]

Oyama

[11] Patent Number: 5,003,809

[45] Date of Patent: Apr. 2, 1991

[54] METHOD OF MOUNTING AND DEMOUNTING MOLDS TO AND FROM PRESS MOLDING MACHINE

[75] Inventor: Masayuki Oyama, Kiryu, Japan

[73] Assignee: Mitsuba Electric Mfg. Co., Ltd., Kiryu, Japan

[21] Appl. No.: 516,437

[22] Filed: Apr. 30, 1990

[30] Foreign Application Priority Data

May 2, 1989 [JP] Japan ..... 1-113261

[51] Int. Cl.[5] ..... B21D 37/04

[52] U.S. Cl. ..... 72/446; 72/379.2

[58] Field of Search ..... 72/347, 351, 446, 448, 72/404, 472, 379.2

[56] References Cited

U.S. PATENT DOCUMENTS 1,142,782 6/1915 Carlson ..... 72/472
3,266,281 8/1966 Fust ..... 72/472
4,863,333 9/1989 Kaminski ..... 72/347
4,866,975 9/1989 Hopkins ..... 72/448

*Primary Examiner*—David Jones
*Attorney, Agent, or Firm*—Scully, Scott, Murphy & Presser

[57] ABSTRACT

In a method of mounting and demounting at least two, upper and lower dies to and from a press molding machine, a workpiece is inserted into a press position between the upper and lower dies. The workpiece is then pressed or stamped at the press position by the upper and lower dies. The upper and lower dies are maintained at the press position to leave the workpiece after having been pressed or stamped, at the press position between the upper and lower dies. The upper and lower dies are mounted and demounted to and from the press molding machine, with the workpiece maintained at the press position between the upper and lower dies.

9 Claims, 2 Drawing Sheets

METHOD OF MOUNTING AND DEMOUNTING MOLDS TO AND FROM PRESS MOLDING MACHINE

BACKGROUND OF THE INVENTION

The present invention relates to methods of mounting and demounting upper and lower dies to and from press molding machines and, more particularly, to a method of mounting and demounting upper and lower dies, which is suitably used in a press molding machine of transfer type Generally, when a pair of upper and lower dies of a press molding machine are replaced by other ones, mounting and demounting of the upper and lower dies are done as follows. That is, after pressing has been completed, the upper die is moved upwardly with respect to the lower die to remove a workpiece after having been molded. Subsequently, clamping of the upper die is released When the clamping of the upper die is released under the condition described above, however, the upper die tends to fall down toward the lower die. Thus, it is required to hold or retain the upper die in any manners.

In view of the above, conventionally, the following method is taken. That is, as shown, for example, in FIG. 2 of the attached drawings, after molding operation has been completed to remove a workpiece from the press molding machine, a storage post 4 is mounted to an outer periphery of a guide post 3 which is mounted to an upper die 1 in an integral manner and which is slidably in a lower die 2 for sliding movement relative thereto. Both upper and lower ends of the storage post 4 are engaged respectively with the upper and lower dies 1 and 2. By doing so, the positional relationship between the upper and lower dies 1 and 2 can be retained.

As shown in FIG. 3, the storage post 4 is constructed as follows. That is, the storage post 4 is formed generally into a cylindrical shape, and has a peripheral wall whose part is formed therein with a cut-out 4*a*. The guide post 3 is inserted with respect to the storage post 4 through the cut-out 4*a*. The storage post 4 is formed, at its upper and lower ends, with engaging steps 4*b* and 4*b* with which parts of the respective upper and lower dies 1 and 2 are engaged respectively.

However, the following problems still remain even by the conventional method described previously.

Specifically, when the upper and lower dies 1 and 2 are replaced by other ones, it is required to mount and demount the storage post 4 to and from the guide post 3. This increases working steps. Further, since the storage post 4 is separate from the press molding machine, the operation by the use of the separate storage post 4 becomes complicated and troublesome. Moreover, in the case where the storage post 4 is broken due to setting mistake in pre-slide position at a program of the upper and lower dies, or due to the other reasons, other mold parts or components are reduced in accuracy.

Furthermore, since it is impossible for the storage post 4 to bring both the upper and lower dies 1 and 2 to a completely fixed condition, continuous operation of the press molding machine is impossible immediately after the upper and lower dies 1 and 2 have been set, and single processing is required of the order of ten (10) times. Thus, this causes prolongation of the replacement operation of the upper and lower dies 1 and 2.

SUMMARY OF THE INVENTION

It is therefore an object of the invention to provide a method of mounting and demounting at least two, upper and lower dies to and from a press molding machine, which is capable of dissolving the above-described problems and which is capable of shortening program operation to improve a serviceability ratio of the press molding machine.

According to the invention, there is provided a method of mounting and demounting at least two, upper and lower dies to and from a press molding machine, the method comprising the steps of:

inserting a workpiece into a press position between the upper and lower dies;

pressing or stamping the workpiece at the press position by the upper and lower dies;

maintaining the upper and lower dies at the press position to leave the workpiece after having been pressed or stamped, at the press position between the upper and lower dies; and mounting and demounting the upper and lower dies to and from the press molding machine, with the workpiece maintained at the press position between the upper and lower dies.

With the arrangement of the invention, after the workpiece has been pressed or stamped by the upper and lower dies, the upper and lower dies are held or retained at the press position, and the workpiece is left at the press position within the upper and lower dies.

By doing so, the upper and lower dies are firmly connected to each other under press pressure through the workpiece after having been molded.

Accordingly, even at mounting and demounting of the upper and lower dies and transportation thereof as well as storage thereof, it is ensured that shift or deviation between the upper and lower dies is restricted.

Thus, the following superior advantages can be obtained by the invention.

The upper and lower dies are mounted and demounted to and from the press molding machine under such a condition that the workpiece is pressed between the upper and lower dies, whereby the upper and lower dies are firmly united together without the use of a separate member or element, so that it is possible to retain the upper and lower dies to a set positional relationship.

As a result, positioning operation at remounting of the upper and lower dies is simplified so that program operation can be shortened. Thus, it is possible to considerably improve the serviceability ratio of the press molding machine.

DESCRIPTION OF THE EMBODIMENTS

Figure 1:
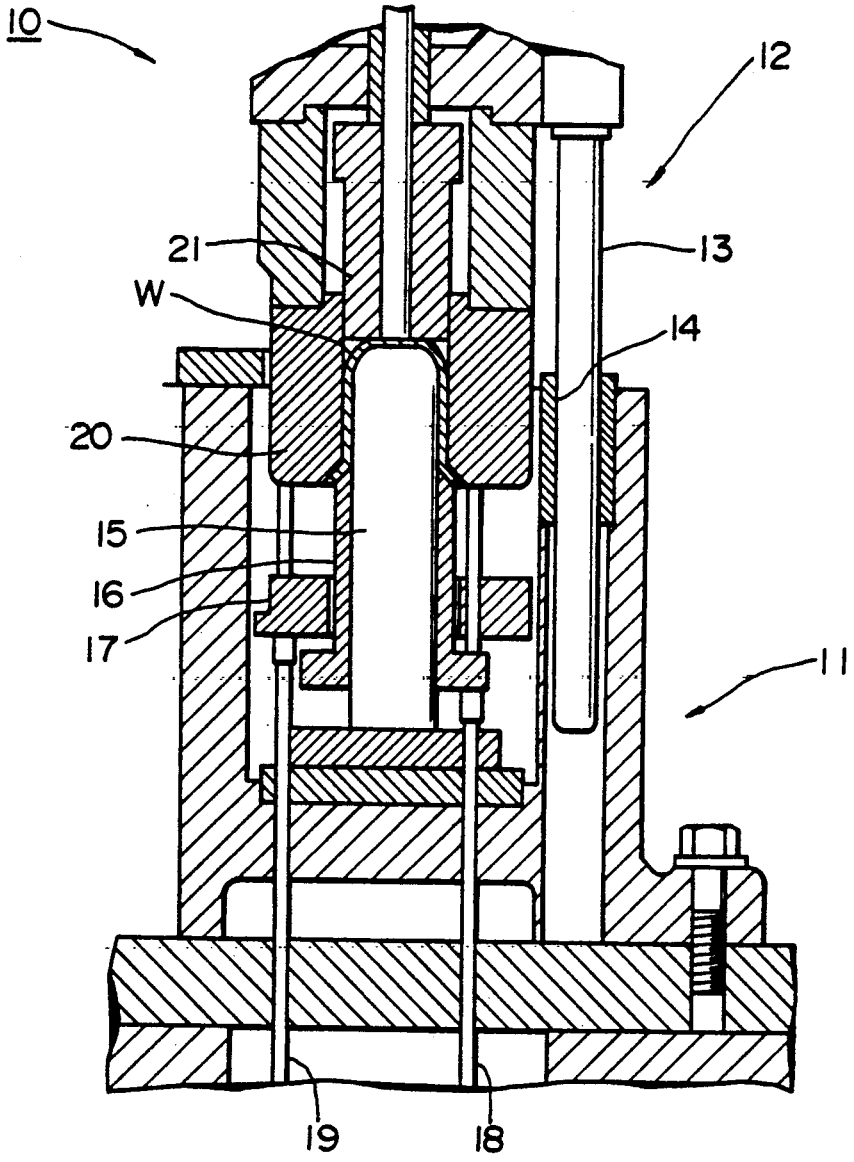
FIG. 1 is a fragmentary vertical cross-sectional view showing a press molding machine to which the invention is applied.
Figure 2:
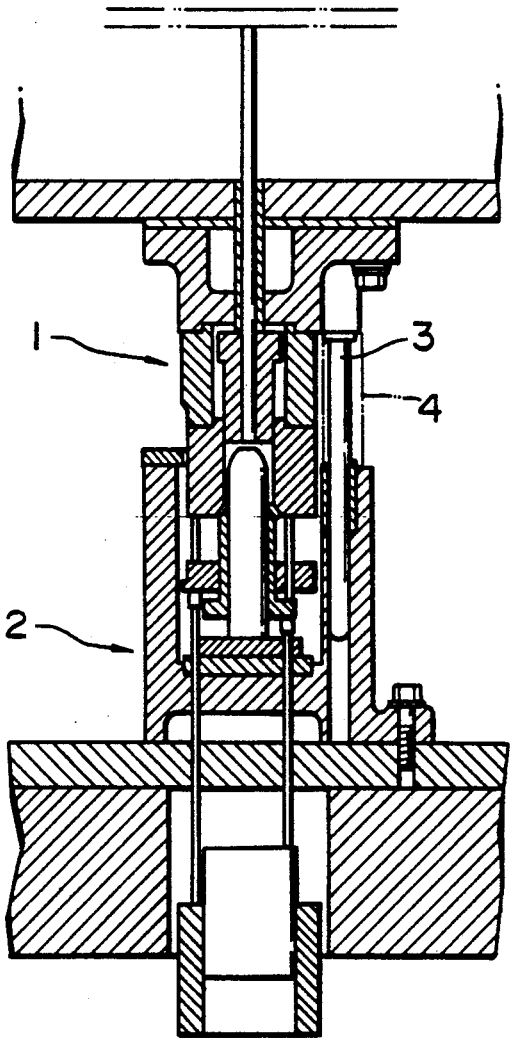
FIG.2 PRIOR ART
FIG. 2 is a fragmentary vertical cross-sectional view showing a press molding machine for explanation of the conventional method of mounting and demounting a pair of upper and lower dies.
Figure 3:
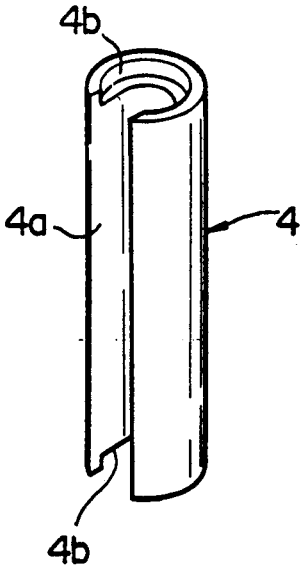
FIG.3 PRIOR ART
FIG. 3 is an enlarged respective view showing a jig which is used in the conventional method of mounting and demounting the upper and lower dies illustrated in FIG. 2.

Referring to FIG. 1, there is shown a press molding machine, generally designated by the reference numeral 10, to which the invention is applied.

The press molding machine 10 comprises a fixed or stationary lower die 11 and an upper die 12 which is movable vertically with respect to the lower die 11 by a press ram (not shown). A guide post 13 is mounted to the upper die 12 in an integral manner, and extends along the vertical movement of the upper die 12. The guide post 13 is slidably fitted in a guide bore 14 which is formed in the lower die 11. Thus, both the lower and upper dies 11 and 12 can be moved vertically under a predetermined positional relationship.

Further, a punch 15 is mounted to the lower die 11 for restricting an inner configuration of a workpiece W. The punch 15 has its outer periphery about which a knockout sleeve 16 is slidably fitted for removing the workpiece W from the punch 15.

The knockout sleeve 16 has its outer periphery about which an elevating table 17 is slidably fitted for holding or retaining the workpiece W before commencement of pressing. The knockout sleeve 16 and the elevating table 17 have their respective lower ends against which cushion pins 18 and 19 are abutted. By the cushion pins 18 and 19, the knockout sleeve 16 and the elevating table 17 are always biased upwardly.

On the other hand, the punch 15 is inserted into the upper die 12, accompanied with downword movement thereof, and a siding die 20 is mounted to the upper die 12 for restricting an outer configuration of the workpiece W. A preset rod 21 is mounted within the siding die 20 for vertical movement. The preset rod 21 is moved downwardly prior to the siding die 20 when the upper die 12 is moved downwardly. The workpiece W is clamped between the preset rod 21 and the punch 15.

The operation of the press molding machine 10 constructed as above and a mounting and demounting method according to an embodiment of the invention will next be described below.

It will first be described to press-mold the workpiece W. The upper die 12 is moved upwardly to open a location between the lower and upper dies 11 and 12. The workpiece W rests on the lower die 11.

Downward movement of the upper die 12 causes the workpiece W to be pressed or stamped by the punch 15 of the lower die 11 and the siding die 20 of the upper die 12.

After the workpiece W has been pressed or stamped, the upper die 12 is moved upwardly to release press pressure, and the knockout sleeve 16 is moved upwardly by the cushion punch 18. Thus, the workpiece W is removed from the punch 15.

The workpiece W after having been pressed or stamped in the manner described above is transported to a subsequent processing step.

The above-mentioned operation is successively repeated so that continuous pressing or stamping is done.

The mounting and demounting method of the lower and upper dies 11 and 12 will next be described.

At the time pressing or stamping of a predetermined number of workpieces W has been completed, and at the time pressing or stamping of the last workpiece W has been completed, operation of the upper die 12 is suspended, and the upper die 12 is suspended at the lowermost position, as illustrated in FIG. 1.

Under this condition, clamping of the upper die 12 with respect to the press ram is released.

When clamping of the upper die 12 is released, a frictional force substantially equal to the press pressure occurs between the upper and lower dies 12 and 11 and the workpiece W. By this frictional force, the upper die 12 is supported by the lower die 11 through the workpiece W. Since the press pressure is larger than the weight of the upper die 12, falling-down of the upper die 12 is prevented by the frictional force. Thus, the upper and lower dies 12 and 11 are retained to the positional relationship illustrated in FIG. 1.

As described above, it is ensured that the upper die 12 is easily removed from the press molding machine 10. Further, even after the upper die 12 has been demounted or removed, a positional relationship between the upper and lower dies 12 and 11 can accurately be retained to the positional relationship at the pressing or stamping.

Thus, not only any separate elements or members can be dispensed with at transportation and storage of the upper and lower dies 12 and 11 after having been demounted, but also any extraordinary operation can be dispensed with.

Further, when the lower and upper dies 11 and 12 are again mounted to the press molding machine 10, positioning between the lower and upper dies 11 and 12 has already been done. Accordingly, if the lower and upper dies 11 and 12 are set to their predetermined positions on the press molding machine 10 and, subsequently, clamping is made to the upper die 12, it is possible to again mount the lower and upper die 11 and 12 to the press molding machine 10 without troublesome positioning.

Moreover, the accurate positioning between the lower and upper dies 11 and 12 has been completed simultaneously with the re-mounting thereof. Thus, press molding can be done without any issues, even if operation immediately proceeds to the continuous operation.

As described above, according to the embodiment of the invention, quick or rapid mounting and demounting of the lower and upper dies 11 and 12 are made possible simply or easily and at high accurate. Thus, an attempt can be made to a considerable improvement in the serviceability ratio of the press molding machine 10.

In connection with the above, the construction of the press molding machine 10 in the embodiment is a mere example. The invention can be applied to, for instance, a press molding machine of type in which a plurality of sets of molds are arranged in parallel relation to each other, and are operated together. In this case, since positioning between the plurality of sets of molds can also be dispensed with, serviceability or usefulness can further be raised.

What is claimed is:

1. A method of mounting and demounting at least two, upper and lower dies to and from a press molding machine, said method comprising the steps of:

inserting a workpiece into a press position between said upper and lower dies;

pressing or stamping said workpiece at said press position by said upper and lower dies;

maintaining said upper and lower dies at said press position to leave the workpiece after having been pressed or stamped, at said press position between said upper and lower dies; and mounting and demounting said upper and lower dies to and from said press molding machine, with said workpiece maintained at said press position between said upper and lower dies.

2. The method according to claim 1, wherein said lower die is stationary, while said upper die is movable vertically with respect to said lower die.

3. The method according to claim 1, wherein said press molding machine comprises guide post means which is mounted to said upper die in an integral manner, said guide post means extending along a direction parallel to the direction of movement of said upper die, and wherein said lower die is formed therein with guide bore means in which said guide post means is fitted for a sliding movement, so that said upper and lower dies are moved vertically under a predetermined positional relationship.

4. The method according to claim 1, wherein said press molding machine comprises a punch means which is mounted to said die for restricting an internal configuration of said work piece, and knockout means which is slidingly fitted to said punch means for the removing of said work piece from said punch means.

5. The method according to claim 4 wherein said knockout means is a sleeve means and the sleeve means is fitted about an outer periphery of said punch means.

6. The method according to claim 4, wherein said press molding machine comprises an elevating table which is slidably fitted about an outer periphery of said knockout sleeve means for holding said workpiece before commencement of pressing.

7. The method according to claim 5, wherein said press molding machine comprises a pair of cushion punch means which are abutted respectively against lower ends of the respective knockout sleeve means and elevating table so that said knockout sleeve means and said elevating table are always biased upwardly by the respective cushion punch means.

8. The method according to claim 4, wherein said press molding machine comprises siding die means which is mounted to said upper die for restricting an outer configuration of said workpiece.

9. The method according to claim 7, wherein said press molding machine comprises preset rod means which is mounted within said siding die means for vertical movement, said preset rod means being moved downwardly prior to said siding die means when said upper die is moved downwardly to clamp said workpiece between said preset rod means and said punch means.

* * * * *